US005223882A

United States Patent [19]

Beckmann

[11] Patent Number: 5,223,882

[45] Date of Patent: Jun. 29, 1993

[54] APPARATUS FOR WET TREATMENT OF WEBS OF PHOTOSENSITIVE MATERIAL

[75] Inventor: Lutz Beckmann, Munich, Fed. Rep. of Germany

[73] Assignee: Agfa-Gevaert Aktiengesellschaft, Leverkusen, Fed. Rep. of Germany

[21] Appl. No.: 893,123

[22] Filed: Jun. 3, 1992

[30] Foreign Application Priority Data

Jul. 1, 1991 [DE] Fed. Rep. of Germany ..... 4121730

[51] Int. Cl.[5] ..... G03D 3/08

[52] U.S. Cl. ..... 354/319; 354/321; 354/339

[58] Field of Search ..... 354/297, 319, 320, 323, 354/324, 337, 339

[56] References Cited

U.S. PATENT DOCUMENTS 4,967,222 10/1990 Nitsch ..... 354/321

*Primary Examiner*—D. Rutledge
*Attorney, Agent, or Firm*—Peter K. Kontler

[57] ABSTRACT

A tank for wet treatment of a running web of photosensitive material has a set of upper pulleys and a set of lower pulleys mounted on a common support and movable up and down toward and away from the upper pulleys. The web is alternatingly trained over the upper and lower pulleys to advance along a meandering portion of its path from a first drive at the inlet into the body of liquid in the tank to a computer-controlled second drive at the locus of emergence of the web from the body of liquid. At least one additional drive is provided for one or more median upper pulleys to thus reduce the tensional stress upon the repeatedly looped running web. The additional drive can employ a capacitor motor, a d-c motor, a hysteresis motor or clutch, a pneumatic motor or a hydraulic motor. Such additional drive can rotate the respective upper pulley at a constant speed or at a speed which varies as a function of changes in the speed of advancement of the web through the body of liquid. The web is tensioned solely by the weight of the lower pulleys and of the common support for the lower pulleys.

17 Claims, 1 Drawing Sheet

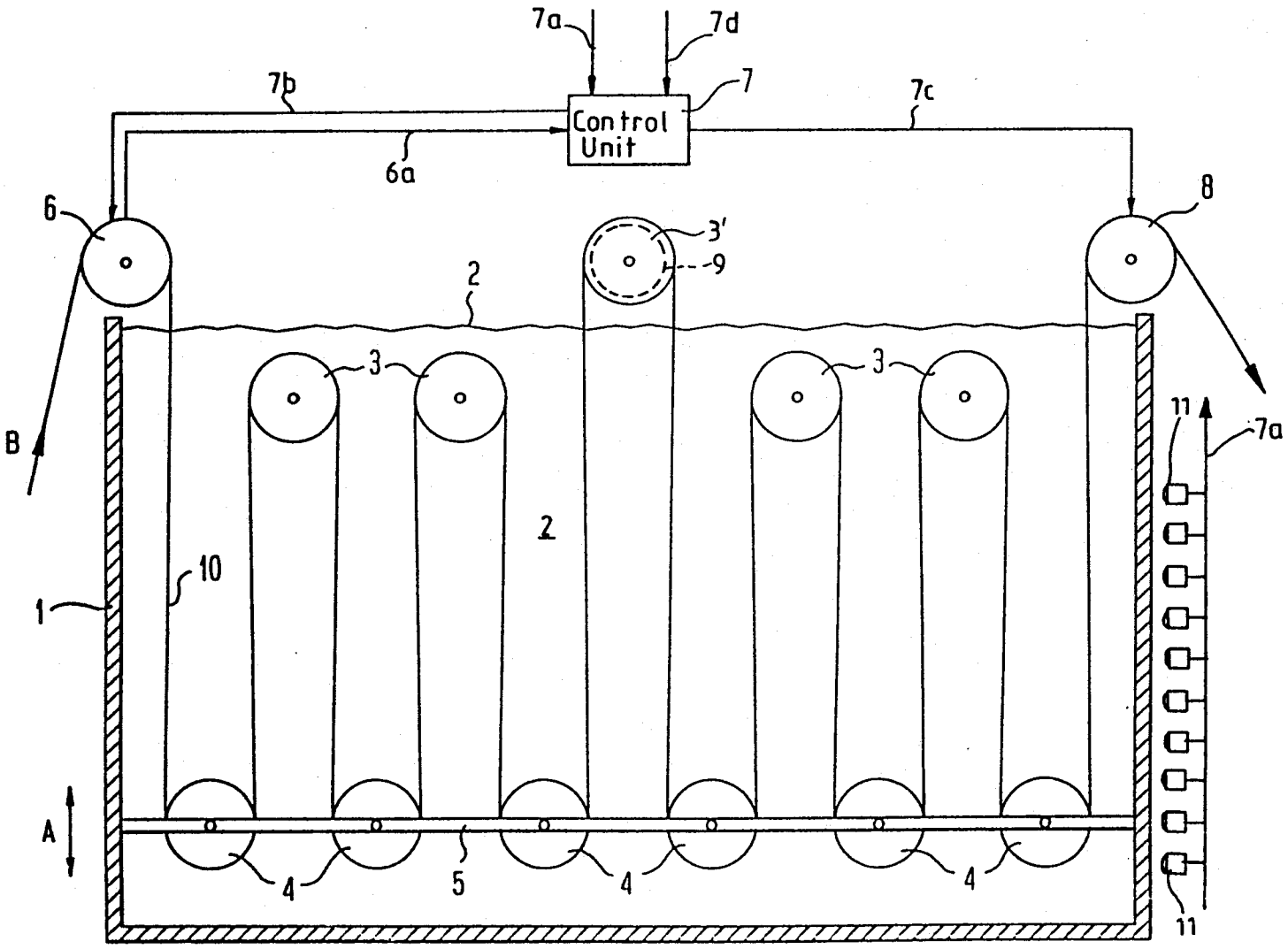
7a
8
11
11
7c
7d
7
Control Unit
7a
3'
9
2
2
6a
7b
3
3
4
4
4
5
10
6
B
1
A

APPARATUS FOR WET TREATMENT OF WEBS OF PHOTOSENSITIVE MATERIAL

BACKGROUND OF THE INVENTION

The invention relates to improvements in apparatus for treating running webs of photosensitive material, such as exposed but undeveloped photographic films or strips of photographic paper. More particularly, the invention relates to improvements in apparatus for wet treatment of running webs of photosensitive material. Still more particularly, the invention relates to improvements in apparatus of the type disclosed in commonly owned U.S. Pat. No. 4,967,222 granted Oct. 30, 1990 to Wilhelm Nitsch for "Method of and machines for treating webs of photographic material". The disclosure of this patent is incorporated herein by reference.

Large photographic processing laboratories, wherein exposed customer films are developed and selected developed film frames are imaged on photographic paper, tend to utilize entire production lines in an effort to reduce the number of attendants and to speed up the developing, copying and printing operations. A modern production line is designed in such a way that neither the films nor the photographic paper must be stored at any location between the inlet for cartridges or cassettes which contain customer films and the outlet for sections of exposed and developed customer films and the corresponding prints on exposed and developed photographic paper. Thus, when such processing laboratories, known as maxilabs, receive cassettes of customer film, an attendant at the inlet of a production line inserts successive cassettes into a dark chamber and the cassettes are automatically relieved of exposed films, the films are spliced together end-to-end into a long web of coherent films, the web is caused to pass through a developing machine, the developed web is caused to pass through a copying machine wherein selected film frames are imaged onto photographic paper, the paper is thereupon developed, and the thus obtained prints are separated from each other and gathered with the associated film sections to be withdrawn by an attendant at the outlet of the production line. Such attendant inserts the prints and the associated customer films into envelopes which are picked up or shipped to dealers or directly to customers. All this is fully described and illustrated in the patent to Nitsch. It has been found that the output of a production line of the above outlined character is much higher than the output of a series of discrete machines which are in use in many conventional photographic processing laboratories. Of course, a prerequisite for proper functioning of a production line is that the operation of each of its constituents (such as discrete splicing, developing, copying, severing and other units) is properly synchronized with the operation of each other constituent. Serious problems are encountered in connection with the synchronization of operation of the developing unit for photographic paper with the operation of the preceding and following units. The reason is that, in order to obtain sharp reproductions of images of selected exposed and developed film frames, photographic paper must be maintained in each bath of the developing unit for an accurately determined interval of time.

Nitsch discloses a method and an apparatus for selecting the length of the path for a web of photo-sensitive material through a liquid bath as a function of the speed of the web so that the interval of contact between the body of liquid and each film frame or each unit length of photographic paper remains unchanged even if the speed of the web varies within a wide range. The patented apparatus employs tanks with sets of upper and lower pulleys, and the webs are trained alternatingly over the upper and lower pulleys so that they advance along meandering paths. The upper pulleys are rotatable about fixed axes and the lower pulleys are mounted on a common carrier or support which is guided in the respective tank for movement toward and away from the upper pulleys. Thus, the length of the path for a running web through a particular liquid bath can be increased or reduced by the simple expedient of moving the lower pulleys away from or toward the respective upper pulleys. The common carrier or support for the lower pulleys can be moved up and down by a motor in dependency on the momentary speed of the web in the respective tank. A web drive at the discharge end of the tank cooperates with the drive for the vertically movable carrier or support in order to ensure that the speed of withdrawal of successive increments of the web is properly synchronized with the movements of the lower pulleys toward or away from the upper pulleys and to thus ensure that the period of dwell of each increment of a web in the respective body of liquid matches an optimal interval of time. The just described controls of Nitsch are reliable but rather complex and expensive.

Furthermore, it has been found that friction between the liquid in a developing or other tank and the running web of photosensitive material, especially photographic paper, rises considerably when the web is transported at a presently required speed of approximately 50 meters per minute. Such friction causes the development of a pronounced tensional stress in the material of the web, and the tensional stress rises as a result of training of the web upon a series of pulleys, sheaves or like web guiding or deflecting members. In fact, the tension in a web which has been trained over five pulleys can reach a value at which the web tears to thereby cause lengthy interruptions in the operation of the entire production line. Proposals to avoid such undue tensional stressing of the web include the provision of relatively small web guiding and advancing assemblies each of which employs a small number of upper and lower pulleys (so that the total number of deflections of a web which is being advanced by one of these assemblies is not more than five), a carrier for the lower pulleys, a drive at the outlet end of the assembly and a drive for the carrier. Each tank of the developing unit employs two or more assemblies of the above outlined character, and the breaking up of the apparatus of Nitsch into two or more assemblies is carried out for the sole purpose of avoiding tearing of the web in a body of developing, fixing, rinsing or other liquid. It is clear that the utilization of two or more web advancing and guiding assemblies in each tank of a developing machine for photographic paper or other photosensitive material contributes significantly to the cost of the production line.

OBJECTS OF THE INVENTION

An object of the invention is to provide a novel and improved apparatus for wet treatment of running webs of photosensitive material which is less likely to tear and/or otherwise damage the web than heretofore known apparatus.

Another object of the invention is to provide a developing machine which embodies the above outlined apparatus.

A further object of the invention is to provide a production line with one or more developing machines at least one of which embodies the above outlined apparatus.

An additional object of the invention is to provide a novel and improved combination of web guiding elements and web drives for use in a developing machine for photographic paper or other photosensitive material.

Still another object of the invention is to provide an apparatus which is simpler than heretofore known apparatus even though it is equally capable of preventing the development of excessive tensional stresses in, and eventual tearing of, running webs of photographic paper or the like.

A further object of the invention is to provide an apparatus which can be incorporated with advantage in existing production lines for exposed photographic films.

Another object of the invention is to provide novel and improved composite drive means for the elements which guide running webs of photographic paper or the like through a tank containing a body of liquid wherein successive increments of the web must or should dwell for selected intervals of time.

An additional object of the invention is to provide a method of reducing the likelihood of tearing of a running web of photosensitive material which is trained over a large number of pulleys and is advanced through a body of liquid at a speed which at least approximates 50 meters per minute.

Another object of the invention is to provide a combination of a tank for a body of liquid, pulleys for a running web of photographic paper or the like, and drive means for the web.

A further object of the invention is to provide a novel and improved auxiliary drive for at least one pulley of the above outlined apparatus.

An additional object of the invention is to provide an apparatus wherein the pulleys of a lower set of pulleys need not be moved up and down by a motor.

SUMMARY OF THE INVENTION

The invention is embodied in an apparatus for treating a running web of photosensitive material, such as exposed but undeveloped photographic roll film or photographic paper. The improved apparatus comprises a vessel for a body of liquid (e.g., a tank for a supply of developing solution), and means for guiding the web in a predetermined direction along a predetermined path having an elongated portion extending at least in part through the body of liquid in the vessel. The guiding means comprises a first set of pulleys which are or which can be located at a level above the body of liquid, and a second set of pulleys located in the body of liquid beneath the pulleys of the first set. At least one set of pulleys is movable toward and away from the other set to thereby respectively reduce and increase the length of the elongated portion of the path. The apparatus further comprises a first web drive which is adjacent the path upstream of the elongated portion and a second web drive adjacent the path downstream of the elongated portion. At least one of these drives is preferably adjustable to vary the speed of advancement of the web along the elongated portion of the path, and the apparatus further comprises at least one additional web drive which is adjacent the elongated portion of the path, i.e., which is located donwstream of the first drive but upstream of the second drive.

The elongated portion of the path is preferably a meandering portion in that the web is alternatingly trained over the pulleys of the first and second sets.

The at least one additional drive can comprise a constant-speed motor or a variable-speed motor whose speed varies with varying speed of the web in the elongated portion of the path, for example, in such a way that the speed of the motor increases in response to increasing speed of the web in the elongated portion of the path.

The at least one additional drive can be connected to and then rotates a pulley of the first set.

It is presently preferred to assemble the guiding means in such a way that the second set of pulleys is movable up and down toward and away from the pulleys of the first set. Furthermore, the second drive is preferably adjustable to vary the speed of advancement of the web along the elongated portion of the path. The pulleys of the second set can be carried by and then bear merely under the action of gravity upon the web in the elongated portion of the path. Such apparatus can comprise a common support or carrier for the pulleys of the second set.

The at least one additional drive can comprise a capacitor motor, a d-c motor, a hydraulic motor, a pneumatic motor, a hysteresis motor or a hysteresis clutch.

The at least one drive can be connected to and then serves to rotate a median pulley of the first set at a level above the body of liquid in the vessel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single Figure of the drawing is a schematic partly elevational and partly vertical sectional view of an apparatus which embodies one form of the invention and is installed in a developing machine for photographic films or photographic paper, the apparatus having a single additional drive which is connected to and serves to rotate the median pulley of the upper set of pulleys for a running web of photosensitive material.

DESCRIPTION OF PREFERRED EMBODIMENTS

The apparatus which is shown in the drawing comprises a vessel or tank 1 for a body of liquid 2. The top surface 2*a* of the confined body of liquid 2 extends to a level above four pulleys 3 of a first set of five pulleys, and the means for guiding a running web 10 of photosensitive material along an elongated portion of the path for the web (namely along a portion which extends at least in part through the body of liquid 2) further includes a second set of pulleys 4 which are rotatable about fixed parallel horizontal axes, and the pulleys 4 of the second set are mounted on a common carrier or support 5 which is movable in the vessel 1 up and down along suitable guide means (not shown) in the form of rails, tracks or the like. The pulleys 3 and 4 jointly define an elongated meandering portion of an elongated path for the web 10 because the web is alternatingly trained over the pulleys 3 and 4.

The apparatus further comprises a first web drive 6 upstream of the elongated portion of the path for the web 10 (the latter is advanced in the direction of arrow B), a second web drive 8 which is located downstream of the last or rightmost pulleys 3 and 4, a control unit 7 which receives signals from the drive 6 and serves to transmit signals to the drive 8, and at least one additional or auxiliary drive 9. In the illustrated embodiment of the improved apparatus, the single additional drive is connected to and serves to rotate a median or intermediate pulley 3' which is installed in the tank 1 and/or in another stationary part of the developing machine at a level above the top surface 2a of the body of liquid 2 in the tank 1. If the tank 1 is replaced with a larger tank, each set of pulleys will comprise or can comprise more than five pulleys and the improved apparatus is then provided with two or more additional or auxiliary drives 9. The overall number of additional drives 9 can be selected in such a way that the web 10 is not looped more than five times ahead (upstream) of as well as behind (downstream of) each additional drive. The illustrated apparatus employs a first set of five pulleys (3 and 3') and a second set of six pulleys 4. The web 10 is looped five times between the drive 6 and the drive 9, and the web is looped five times between the drives 9 and 8. The double-headed arrow A indicates the directions of movement of the support 5 toward and away from the pulleys 3, 3' of the first or upper set. The support 5 need not be provided with a discrete drive (such discrete drive is used in the apparatus of Nitsch); the pulleys 4 merely bear against the adjacent portions of the web 10 under the action of gravity and maintain the web under requisite tension while successive increments of the web advance from the drive 6, through the body of liquid 2, around the median pulley 3', again through the body of liquid 2, around the pulley or sheave of the drive 8 and on to the next section of the developing machine or to a unit following the developing machine which embodies the improved apparatus and forming part of a production line in a maxilab or in a similar establishment.

The speed of the variable-speed drive 6 depends upon the speed of the web 10 in the preceding tank of the developing machine or (if the tank 1 is the first or foremost tank of a developing machine) upon the speed of the web 10 in the preceding unit of the production line. For example, and assuming that the web 10 consists of photographic paper, the preceding unit can constitute a copying unit wherein the images of selected film frames are transferred onto successive unit lengths of the web 10. The control unit 7 (e.g., a computer) has an input 7a which receives signals denoting the speed of the web 10 in the preceding tank or in the preceding unit (not shown), and the control unit 7 further comprises an output 7b which transmits signals to the drive 6 so that the latter can advance the web 10 into the body of liquid 2 at a requisite speed. A further output 7c of the control unit 7 transmits signals to the drive 8. The control unit 7 includes means for calculating the required speed of the drive 8 on the basis of information which is received from the output 6a of the drive 6 so that the drive 8 ensures that each unit length of the web 10 will be contacted by the body of liquid 2 for a predetermined optimum interval of time.

The additional drive 9 reduces the likelihood of tearing of the web 10 between the drives 6 and 8 in that it rotates the median pulley 3' at a constant speed or at a speed which varies as a function of the speed of advancement of the web 10 through that elongated portion of the web path which extends between the drives 6 and 8, i.e., between the locus of first entry of the web into and the locus of last exit of the web from the body of liquid 2. For example, the additional drive 9 can comprise a capacitor motor (also called a capacitor-start motor) which need not be connected to the control unit 7 because its speed need not be regulated in response to any signals. If the speed of the motor of the additional drive 9 varies, e.g., if such speed rises in response to rising speed of movement of the web 10 in the direction of arrow B), the motor of the drive 9 can receive signals from a suitable tachometer generator which monitors the speed of the drive 8. The arrangement is preferably such that the driving torque of the motor forming part of the drive 9 increases or decreases in response to increasing or decreasing speed of the web 10.

An advantage of the improved apparatus is that the support 5 for the set of pulleys 4 need not be moved up or down by one or more motors as in heretofore known apparatus. The pulleys 4 simply rest on the adjacent portions of the web 10 and thereby tension each of the six looped web portions. Each such looped web portion extends downwardly from a pulley 3 or 3' (or from the drive 6) to a pulley 4 and from such pulley 4 upwardly to the next pulley 3 or 3' (or to the drive 8). The weight of the support 5 also contributes to the tensioning action of the pulleys 4. If the speed of the drive 8 exceeds the speed of the drive 6, the length of looped portions of the web 10 decreases because the support 5 is caused to move upwardly toward the pulleys 3, 3' and vice versa. The information pertaining to the speed of the drive 6 is transmitted to the control unit 7 via output 6a, and the output 7c transmits properly processed signals to the drive 8. The signals which are transmitted via output 7c are indicative of a velocity profile of the web 10, and such signals are transmitted to the drive 8 with a requisite delay in order to ensure that each and every unit length of the web 10 will be contacted by the body of liquid 2 for a predetermined interval of time which is best suited to ensure optimal wet treatment of the web.

As mentioned above, the additional drive 9 need not receive signals from the control unit 7. Its driving torque preferably depends only upon the speed of advancement of the web 10. This ensures that the tensional stresses upon the web 10 between the drives 6 and 8 are greatly reduced without influencing the length of looped portions of the web and/or the intervals of dwell of successive increments of the web in the body of liquid 2. Moreover, tensional stresses upon the web 10 are reduced without resorting to additional and complex controls.

In order to take into consideration and to counteract eventual slippages of the web 10 relative to the pulley of the drive 6 and/or 8, the apparatus can be provided with means for monitoring the level of the support 5 and for transmitting the thus obtained signals to the control unit 7 for calculation of the speed of the drive 8. The drawing shows a battery of photo-electronic detectors 11 which transmit signals to the control unit 7 via input 7d. Other types of monitoring means can be utilized with equal or similar advantage.

In the apparatus which is actually shown in the drawing, the web 10 is deflected or looped a total of eleven times on its way from the drive 6 to the drive 8. It has been found that the provision of a single additional drive 9 which is connected to and rotates the median upper pulley 3' at a constant speed or at a variable speed in a manner as described above will entail a reduction of tensional stress upon the web 10 so that such tensional stress is maintained within the range of 3–10 newtons. The exact magnitude of the tensional stress will depend upon the speed of advancement of the web 10 in the tank 1. Such stress (in the range of 3–10 newtons) is sufficiently low to ensure that the web 10 will not tear in spite of the fact that it is looped as often as eleven times on its way from the drive 6 to the drive 8. If the additional motor 9 is designed to increase the driving torque in response to increasing speed of advancement of the web 10, the lower limit of the aforementioned range of 3–10 newtons can be reduced still further or the upper limit can be lowered below 10 newtons.

Though it is possible to utilize web guiding means with upwardly and downwardly movable upper pulleys 3 and 3', it is presently preferred to install the pulleys 3, 3' for rotation about fixed axes because this simplifies the threading of the leader of a web 10 into the elongated portion of the web path, namely into the path portion between the drives 6 and 8. The median pulley 3' is preferably placed above the level of the top surface 2*a* of the body of liquid 2 in the tank 1 in order to simplify the design of the drive 9 and to render the drive 9 accessible during each stage of operation of the developing machine which embodies the improved apparatus. Furthermore, connection of the motor of the additional drive 9 to an energy source (such as a source of electrical energy or a source of compressed gaseous or pressurized hydraulic fluid) is simplified if the output element of the motor of the drive 9 can rotate about a fixed axis.

The absence of a drive for the support 5 also contributes to simplicity of the improved apparatus. Thus, the support 5 is movable up and down only under the influence of the drive 8 and in dependency upon the combined weight of the pulleys 4 and support 5 as well as the opposing force of the tensioned web 10. In other words, the only drive which must be controlled by the unit 7 is the drive 8 provided that the drive 6 is controlled by signals denoting the speed of movement of the web 10 in the preceding tank or in the preceding unit of the production line.

If the additional drive 9 employs a capacitor motor, the driving torque upon the pulley 3' and hence upon the web 10 can remain constant or varies as a function of variations of the rotational speed of the pulley 3', i.e., it can rise or fall in response to increasing or decreasing speed of advancement of the web 10 through the tank 1. Similar results can be obtained if the additional drive 9 employs a d-c motor. The torque of such d-c motor is constant; however, the supply of electrical energy to the d-c motor can be readily regulated in such a way that the torque increases in response to increasing speed of the web.

If the torque is to remain independent of the speed of advancement of the web 10, the additional drive 9 can employ a hysteresis motor or a hysteresis clutch. Furthermore, and assuming that the developing machine which embodies the improved apparatus and/or another unit of the production line employs one or more hydraulically or pneumatically operated devices, i.e., if the production line is already provided with a source of compressed gaseous fluid and/or with a source of pressurized hydraulic fluid, the additional drive 9 can employ a hydraulic or pneumatic motor (e.g., a pneumatic motor known as LZB 22 and produced and distributed by Atlas Copco Tools GmbH, Leonberg-Eltingen, Federal Republic Germany) because such motor can also ensure the transmission of a substantially constant torque. All in all, the illustrated additional drive 9 or each additional drive, can employ a capacitor motor (e.g., a motor known as EMK 42 which is produced and distributed by SEL, Standard Elektrik Lorenz AG, Landshut, Federal Republic Germany), a d-c motor, a hysteresis motor, a hysteresis clutch (e.g., a clutch known as 2LE9, Type 130, which is produced and distributed by Zahnradfabrik Friedrichshafen AG, Freidrichshafen, Federal Republic Germany), a hydraulic motor or a pneumatic motor as well as any other prime mover which can meet the aforeoutlined requirements.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus of treating a running web of photosensitive material, comprising a vessel for a body of liquid; means for guiding the web in a predetermined direction along a predetermined path having an elongated portion extending at least in part through said body of liquid, said guiding means comprising a first set of pulleys and a second set of pulleys located in said body of liquid beneath said first set, at least one of said sets being movable toward and away from the other set to thereby respectively reduce and increase the length of said portion of said path; a first web drive adjacent said path upstream of said elongated portion; a second web drive adjacent said path downstream of said elongated portion, at least one of said drives being adjustable to vary the speed of advancement of the web along said elongated portion; and at least one additional web drive adjacent said elongated portion of said path.

2. The apparatus of claim 1, wherein said elongated portion is a meandering portion and the web is alternatingly trained over the pulleys of said first and second sets.

3. The apparatus of claim 1, wherein said at least one additional drive comprises a constant-speed motor.

4. The apparatus of claim 1, wherein said at least one additional drive comprises a variable-speed motor whose driving torque varies with varying speed of the web in said elongated portion of said path.

5. The apparatus of claim 1, wherein said at least one additional drive is connected to and rotates a pulley of said first set.

6. The apparatus of claim 1, wherein said second set of pulleys is movable up and down toward and away from the pulleys of said first set.

7. The apparatus of claim 6, wherein said second drive is adjustable to vary the speed of advancement of the web along said elongated portion of said path.

8. The apparatus of claim 7, wherein the pulleys of said second set are carried by and bear under the action of gravity upon the web in said elongated portion of said path.

9. The apparatus of claim 8, further comprising a common support for the pulleys of said second set.

10. The apparatus of claim 1, wherein said at least one additional drive comprises a capacitor motor.

11. The apparatus of claim 1, wherein said at least one additional drive comprises a d-c motor.

12. The apparatus of claim 1, wherein said at least one additional drive comprises a hydraulic motor.

13. The apparatus of claim 1, wherein said at least one additional drive comprises a pneumatic motor.

14. The apparatus of claim 1, wherein said at least one additional drive comprises a hysteresis motor.

15. The apparatus of claim 1, wherein said at least one additional drive comprises a hysteresis clutch.

16. The apparatus of claim 1, wherein at least one of the pulleys of said first set is located at a level above the body of liquid in said vessel.

17. The apparatus of claim 1, wherein said first set includes a median pulley and said at least one additional drive is connected with and is arranged to rotate said median pulley.

* * * * *